US006461394B1

(12) United States Patent
Mattsson

(10) Patent No.: US 6,461,394 B1
(45) Date of Patent: Oct. 8, 2002

(54) DUST BAG FOR USE IN A VACUUM CLEANER

(76) Inventor: Bo Gunnar Mattsson, Movägen 7, Upplands Väsby, S-194 52 (SE)

( * ) Notice: Subject to any disclaimer, the term of this patent is extended or adjusted under 35 U.S.C. 154(b) by 0 days.

(21) Appl. No.: 09/719,543

(22) PCT Filed: Jun. 22, 1999

(86) PCT No.: PCT/SE99/01123

§ 371 (c)(1),
(2), (4) Date: Dec. 18, 2000

(87) PCT Pub. No.: WO99/66824

PCT Pub. Date: Dec. 29, 1999

(30) Foreign Application Priority Data

Jun. 23, 1998 (SE) ..... 9802218
Oct. 13, 1998 (SE) ..... 9803480

(51) Int. Cl.[7] ..... B01D 46/02

(52) U.S. Cl. ..... 55/374; 55/367; 55/369; 55/373; 55/DIG. 2

(58) Field of Search ..... 55/367, 369, 373, 55/374, 378, 381, 382, DIG. 2, 529

(56) References Cited

U.S. PATENT DOCUMENTS 2,528,332 A * 10/1950 Bergquist ..... 55/DIG. 2
3,401,867 A * 9/1968 Long et al. ..... 55/DIG. 2
3,430,843 A * 3/1969 Fesco ..... 55/DIG. 2
3,495,386 A * 2/1970 Bixler et al.
3,572,017 A * 3/1971 Terzuoli ..... 55/267
3,933,451 A * 1/1976 Johansson ..... 55/267
4,539,027 A 9/1985 Förnäs et al.
5,681,630 A * 10/1997 Smick et al. ..... 55/529

FOREIGN PATENT DOCUMENTS

DE 29711157 U1 11/1997
SE 501135 11/1994
SE 507311 5/1998

* cited by examiner

*Primary Examiner*—David A. Simmons
*Assistant Examiner*—Minh-Chau T. Pham
(74) *Attorney, Agent, or Firm*—Jacobson Holman, PLLC

(57) ABSTRACT

A dust bag for vacuum cleaners including a bag shaped member of an air permeable material, adjacent to an inlet opening attachable by an adhering layer to a plate shaped member to facilitate mounting of the dust bag in an intended vacuum cleaner. The adhering layer is protected before use by a removable protective film. The adhering layer includes a number of parts joined with the bag shaped member surrounding an inlet opening, adjacently located and having an increasing distance in relation to each other from the inlet opening, each having an individual protective part of the removable protective film, preferably divided in separate segments by tear off indicates facilitating removal of individual parts of the protective film to adapt the area of resulting adhering layer to utilized plate shaped member, as well as adaption of the inlet opening by tearing off such segments together with underlying bag material. The bag shaped member has preferably a length exceeding the length of the dust bag location in the utilized vacuum cleaner.

8 Claims, 2 Drawing Sheets

DUST BAG FOR USE IN A VACUUM CLEANER

FIELD OF THE INVENTION

The present invention relates to a dust bag for use in a vacuum cleaner, i.e. a preferably bag shaped dust separating and dust collecting container for a vacuum cleaner.

BACKGROUND OF THE INVENTION

Today, there are more than 100 different types of dust bags for vacuum cleaners on the market, which, apart from differences in size, also include in relation to each other different fixing means for attachment of a dust bag at the intended location in each type of vacuum cleaner. The fixing means normally comprises of a rigid plastic or cardboard plate, a so called original plate, which has a configuration adapted for attachment in the intended location for a dust bag with regard to a certain type of a vacuum cleaner, also having a through hole, which, after attachment, is adapted to serve as a connecting part for the flow channel to the vacuum cleaner. The original plate is also often co-acting in different ways in a functional fashion with the vacuum cleaner when the lid to the dust bag location is closed, whereby the shape of same is of even more significant importance. Sealing between the original plate and the flow channel to the vacuum cleaner is accomplished in different ways for different types of vacuum cleaners, e.g. internally against the diameter of the hole in the original plate, or level against the outer surface of same by means of a diameter that slightly exceeds the diameter of the hole. Certain original plates are arranged having an adjacently to the hole attached and substantially completely surrounding sealing member of rubber or similar, which flexibly and sealingly surround a tubular member extending from the flow channel into the vacuum cleaner. The design of the original plates vary considerably with regard to sealing means, hole diameter, outer measurements and shape, and it is thus extremely difficult to accomplish a dust bag for vacuum cleaners which can be used universally, even though the need for such a universally useable dust bag for vacuum cleaners is obvious. This need is underlined by the fact that large department stores only supply a small number of the most common types of dust bags for vacuum cleaners, and that many users thereby are referred to special shops in order to obtain correct type, which obviously also is a problem.

SE-C2-507 311, for example, discloses as previously known the use of a rigid and separate plate shaped member having an opening, a bag having a rigid collapsible flange at its opening and arranged to be inserted through the opening of the plate, and also disclosing that the surface of the flange acting as contact surface against the plate may be arranged with a sealing compound. This embodiment requires that sufficient space exists for the flange by the outer plane of the plate, and does not solve the problem of required adaption to the size of the flow through hole and the geometrical shape of same.

Certain original plates have such large holes and such a hole configuration, or such small outside dimensions, that an attachment surface between the plate shaped member and the flange in such cases become non-existent. Accordingly, a large number of plate types and bag types are required in order to make the proposed solution meet existing demands.

Another previously known alternative solution is disclosed in SE-C2-501 135, which includes a bag of cloth and a front plate with non-changeable dimensions, which by means of, for example, double-sided adhesive tape can be attached to a mounting plate, adapted for intended type of vacuum cleaner. This bag is intended to facilitate repeated use, and the end portion opposed to the front plate is closed by means of releasable adherence between the facing surfaces, in order to make opening/emptying of the bag possible. U.S. Pat. No. 4,539,027 discloses a further previously known solution, in which an outer end portion of a bag shaped member is arranged as a plane having an opening surrounded by a self-adhesive coating protected by a removable protective film. When the protective film has been removed, the bag is intended to be joined to a mounting plate, arranged adapted to intended model of vacuum cleaner. However, this solution has a number of disadvantages, for example, the bag is only held in position by the self-adhesive layer, which results in an obvious risk for disengagement of he bag from the mounting plate, particularly when used in connection with modern vacuum cleaners having large suction effect. The fact that the bag is predetermined to a certain diameter also means that same can not be used for applications requiring a larger hole diameter. Furthermore, the size of the self-adhesive layer can not be changed and adapted to the area of the mounting plate, e.g. when same has a smaller hole than the hole in the bag, a fact that further increases the risk for disengagement of the bag from the mounting plate when used. As a result of such a situation, dust and other impurities collected by the bag would be sucked into the fan means and the motor, and a user would normally be forced to leave the vacuum cleaner to a repair shop for cleaning and service.

SUMMARY OF THE INVENTION

The object of the present invention is to disclose a dust bag for vacuum cleaners of an extremely universal type, which is easily adapted to most existing types of vacuum cleaners, and which also makes certain that the risk for release of dust and other impurities during use is substantially completely eliminated. A further object of the present invention is to disclose a dust bag for vacuum cleaners which in a fast and simple fashion can be adapted to desired type of vacuum cleaner and original plate.

The dust bag for a vacuum cleaner according to the present invention comprises a bag shaped member of an air permeable material, adjacent to an inlet opening arranged to be joined by means of an adhering layer to a plate shaped member adapted to facilitate mounting of the dust bag in intended vacuum cleaner, and having the adhering layer protected before use by a removable protective film, and it is mainly characterized in that the area of said adhering layer is adjustable by means of a number of parts joined with the bag shaped member surrounding an intended or existing inlet opening, adjacently located and having an increasing distance in relation to each other from the inlet opening, each part having an individual protective part of the removable protective film, which preferably are divided in separate segments by means of tear off indications facilitating removal of individual parts of the protective film in order to adapt the area of resulting adhering layer to utilized plate shaped member.

The tear off indications in the protective film are preferably arranged completely or partly extending through underlying adhering layer at the bag shaped member, whereby resulting segments completely or partly can be removed together with underlying bag material when adjusting the shape, size and/or position of the inlet opening. The free length of the bag shaped member is advantageously arranged to exceed the length of the location intended for the bag in order to cause a support for the closed end portion of the bag shaped member.

BRIEF DESCRIPTION OF THE DRAWINGS

A number of non-restricting examples of embodiments of a dust bag for vacuum cleaners according to the present invention will be more fully described below with reference to the accompanying drawings, in which.

DETAILED DESCRIPTION OF THE PREFERRED EMBODIMENTS

Figure 1:
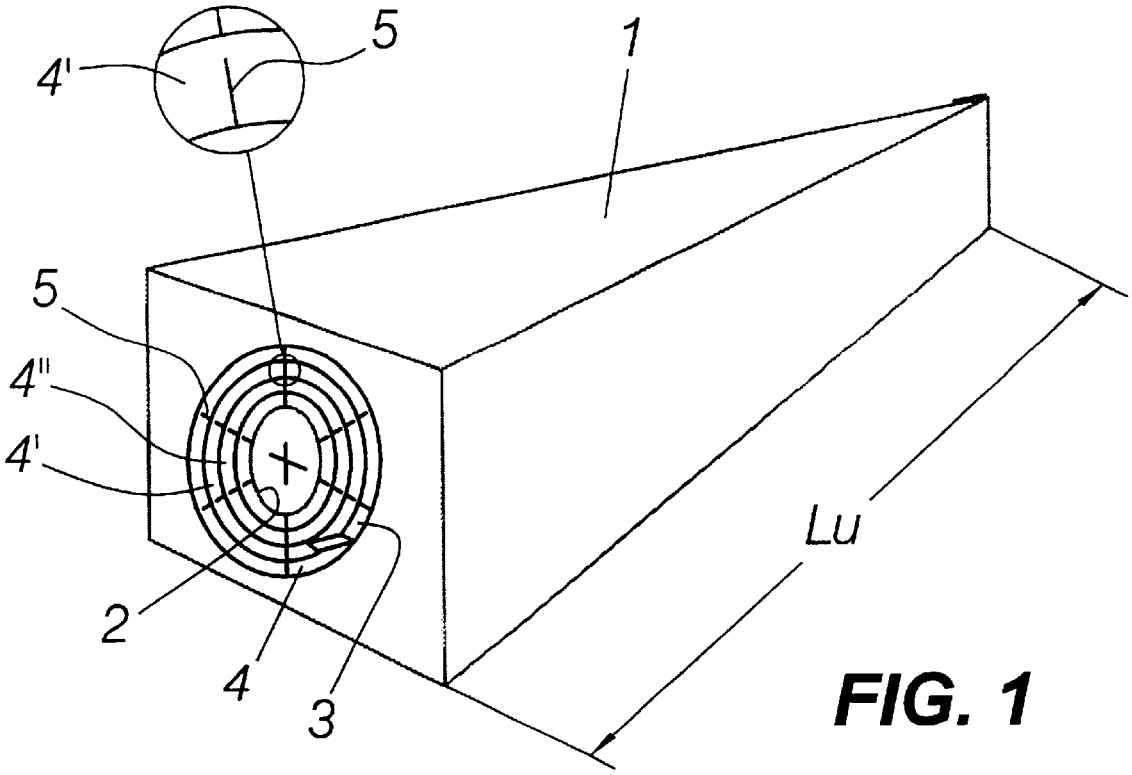
FIG. 1 is a perspective view showing an example of a first embodiment of a dust bag for vacuum cleaners according to the invention, part of which is shown in an enlarged scale.

With reference to FIG. 1, a dust separating bag shaped member of air previous material, e.g. paper, as a complete unit referred to as 1. A circular inlet opening 2 is arranged surrounded by a number of self-adhesive concentrically arranged ring shaped members 3, having a successively increasing diameter in relation to each other, each one having the self-adhesive outer layer protected by a removable protective film 4, 4', 4".

An underlying self-adhesive member 3 is shown in FIG. 1 with part of the removable protective film shown in a partly removed position.

The self-adhesive and concentrically arranged ring shaped members 3 are, as shown, preferably arranged with tear off indications 5, being radially extending cut through slots, which preferably do not completely divide the ring shaped members 3 into individual segments, i.e. with a non-divided portion remaining. The object of this is to simplify removal of the protective film 4, 4', 4" without affecting the unity of the ring shaped members 3.

The object of the tear off indications 5 is to transfer to the underlying and permanently fixed fairly weak bag material a tear off function in such a way, that both the rings 3, or parts thereof, as well as underlying bag material, simultaneously can be torn off in a simple fashion, in order to adjust the shape and size of the inlet opening 2 to desired configuration.

When used, an original plate 6 from a dust bag 1 intended for the vacuum cleaner is advantageously used, or alternatively may such a plate shaped member 6 be supplied as an accessory to a dust bag for vacuum cleaners according to the invention. The latter solution facilitates supply of a plate shaped member 6 well adapted for repeated use, e.g. made of hard plastic or surface coated cardboard and thus easy to clean. Provided that, when compared, the hole diameter of the plate shaped member 6 does not exceed the hole diameter of the inlet opening 2, the protective film 4, 4', 4" is removed from the rings or segments which are covered by the plate shaped member, which thereafter is pressed against the self-adhesive surfaces made available. Since desired segments of the self-adhesive layer can be made available, a self-adhesive surface of maximum size can be achieved, while the areas of the self-adhesive layer outside the plate shaped member 6 still are being protected by the protective film 4, 4', 4". As a result, in difference to the solution which for example is disclosed in U.S. Pat. No. 4,539,027, no problems will occur due to adherence when the dust bag 1 with associated plate shaped member 6 are fitted into a vacuum cleaner.

Should the hole diameter of the plate shaped member 6 exceed the diameter of the inlet opening 2, or should the location of same be displaced in such a way that same is restricted by a portion adjacent to the edge portion of the inlet opening 2, adjustment is easily accomplished by tearing off ring shaped members 3, or parts thereof, together with underlying bag material. The protective film 4, 4', 4" is thereafter removed with regard to those segments which are covered by the plate shaped member 6 in order to accomplish an adhering surface of maximum size, whereafter same is joined to the plate shaped member 6. Accordingly, this facilitates adjustment to a larger hole diameter, as well as adjustment with regard to the location of a hole existing in the plate shaped member 6.

Even though the method described above to maximize the adhering surface between the plate shaped member 6 and the dust bag 1 results in establishment of an optimally strong joint, total security is not accomplished for maintaining the established joint during use, particularly when used in connection with vacuum cleaners having strong suction effect, in view of the pressure drop which occurs when the air permeability for the material of the dust bag 1 is reduced due to filling up by dust or similar.

Figure 2:
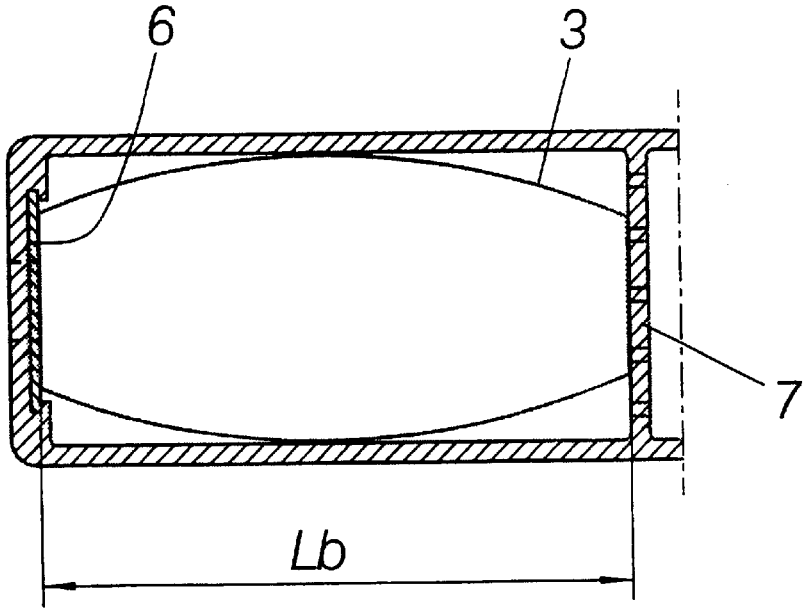
FIG. 2 shows schematically how a dust bag for vacuum cleaners according to the present invention takes up support by means of its rear end portion against existing wall in the location for a dust bag within a vacuum cleaner.

However, necessary security can, as shown in FIG. 2, be accomplished by making the free length Lu of the dust bag 1 (FIG. 1) exceeding the maximum length Lb of the space into which the dust bag 1 is intended to be located. According to the invention, Lu is preferably in the region of 1.2×Lb, and as a result, the closed end portion of the dust bag 1 will take up support against a wall surface 7 existing in the vacuum cleaner, resulting not only in a support for the dust bag 1, but also securing that the pressure drop caused by the bag material creates an intemally acting force in all directions, which also increases the pressure of the self-adhesive area against the plate shaped member 6. The combination of a maximum size self-adhesive surface and the above mentioned added pressure during use results in complete security against release for the established self-adhesive joint during use.

Figure 3:
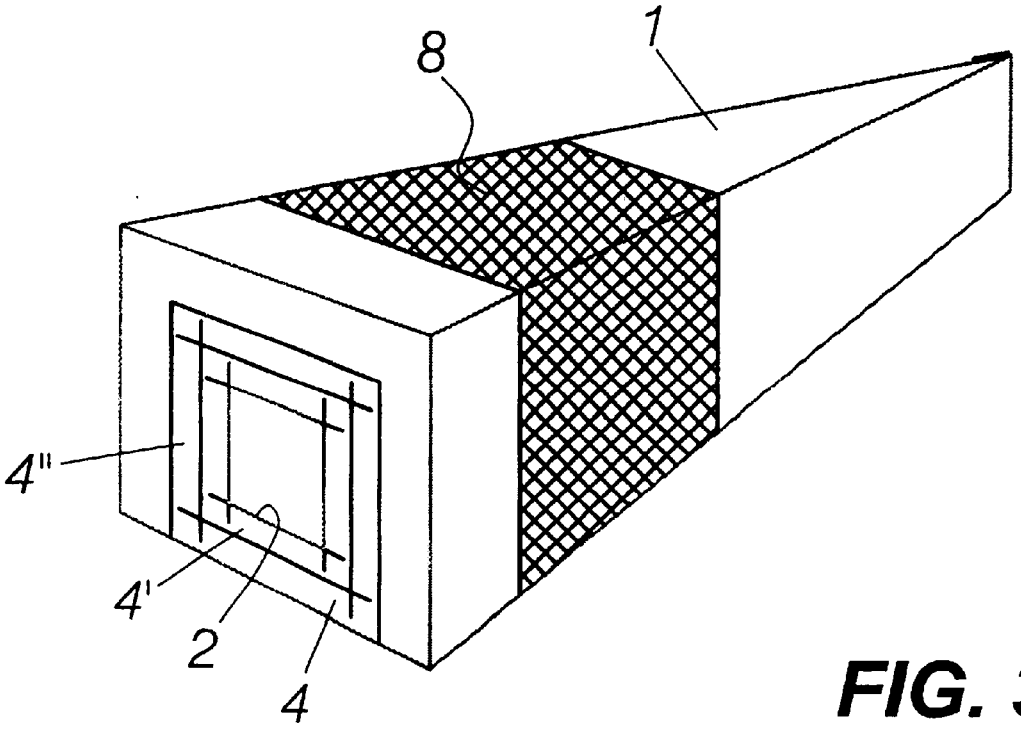
FIG. 3 is a perspective view showing an example of a second embodiment of a dust bag for vacuum cleaners according to the invention.

In the embodiment shown in FIG. 1, the inlet opening 2 is arranged circular and having surrounding circular ring shaped members 3. Also other configurations can be chosen as desired, and an example of an alternative embodiment is shown in FIG. 3. Previously used reference numerals for parts included in FIG. 1 have been used for parts having a corresponding function in FIG. 3.

Accordingly, FIG. 3 shows a bag shaped member 1 of air previous material having a square inlet opening 2, which is surrounded by self-adhesive parts 3, protected by a removable protective film 4, 4', 4", and including tear off indication 5. Obviously, the shape and position of the inlet opening 2 can be adjusted by removal of chosen parts of the self-adhesive parts 3 together with underlying bag material, and that the protective film 4, 4', 4" can be removed with respect to desired remaining segments, whereby a self-adhesive surface of maximum size is accomplished in relation to the plate shaped member against which the bag shaped member 1 is intended to be joined.

Figure 4:
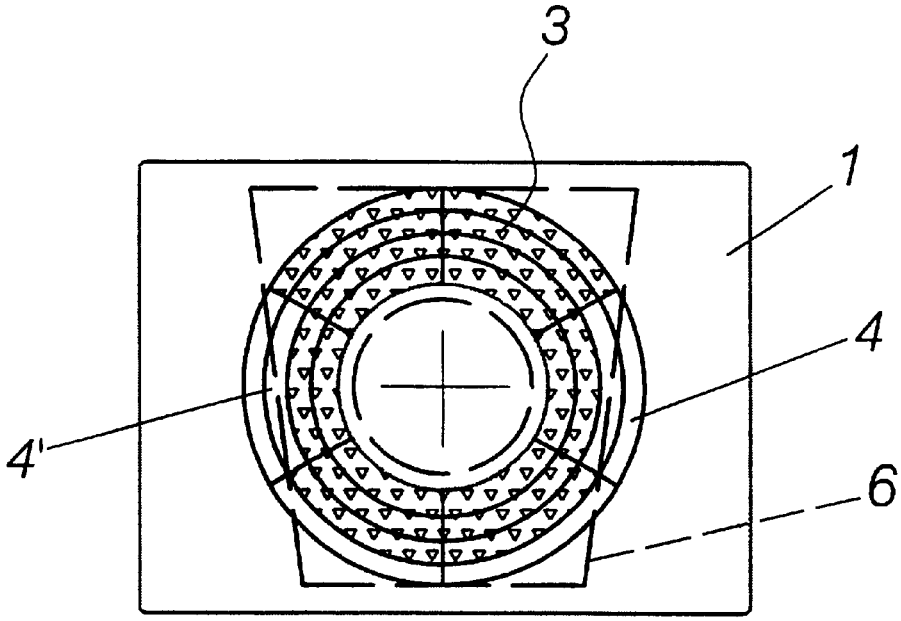
FIG. 4 is a plan view intended to illustrate an example of how adjustment of the adhesive area can be carried out for the example of an embodiment shown in FIG. 1.

An example of this, shown with use of the embodiment of FIG. 1, is shown in FIG. 4. The plate shaped member 6 is shown in broken lines, and the segments of the self-adhesive layer from which the film has been removed, are indicated by triangles.

An example of a further modification of the dust bag 1 for vacuum cleaners according to the present invention is also shown in FIG. 3. As previously mentioned, the dust bag 1 according to the invention is preferably arranged having such a length, that a force is created during use which applies a pressure forcing the dust bag 1 against the attached plate shaped member 6. Since the width of the space available for the bag in certain vacuum cleaners may be rather large, and thus not result in a support preventing expansion in sideways directions, this problem can be resolved by arranging the dust bag 1 having a surrounding net shaped stocking 8, arranged to restrict diametrical expansion of the dust bag 1. Said net shaped stocking can be arranged completely or partly surrounding the bag shaped member 1, integrated with same or removably applied to same. The actual bag material can obviously also be arranged with a suitable type of reinforcement integrated with the wall surfaces of the bag 1, e.g. intermediately located between an outer and an inside layer, in order to accomplish a corresponding result.

With regard to all described examples of embodiments within the scope of the invention, it has been stated that the dust bag includes an inlet opening 2, the size of which can be modified. However, it is obviously also within the scope of the invention that such an inlet opening 2 may substantially be non-existent, and that same is created by the user. In such a case, the surface whereagainst the plate shaped member is intended to be attached can be arranged with a large number of self-adhesive segments 3 of desired and suitable shape, arranged to facilitate removal as required by a user, and arranged to facilitate creation of a suitably located inlet opening 2 having a size adapted to the hole in the plate shaped member.

Self-adhesive parts 3 can also be supplied as separate elements together with a dust bag 1 for vacuum cleaners, intended to be applied in desired position by a user.

A joining layer of thin paper or similar can also be arranged between the dust bag 1 and the self-adhesive parts 3, provided that same has such properties that previously discussed adaption by simultaneous removal of self-adhesive parts 3 and bag material is not influenced.

Shown and described examples of embodiments are obviously not to be regarded as restricting the invention, since further modifications are possible within the scope of the inventive thought and the following claims.

What is claimed is:

1. Dust bag for vacuum cleaners comprising a bag shaped member of an air permeable material, an inlet opening arranged to be joined by an adhering layer to a plate shaped member adapted to facilitate mounting of the dust bag in a vacuum cleaner, and the adhering layer being protected before use by a removable protective film, an area of said adhering layer being adjustable and surrounding the inlet opening, parts of said area having an increasing distance in relation to each other from the inlet opening, each said part having an individual protective part of the removable protective film, divided in separate segments by tear off indications facilitating removal of individual parts of the protective film to adapt the area of the adhering layer to the plate shaped member.

2. Dust bag for vacuum cleaners according to claim 1, wherein the tear off indications in the protective film at least partly extend through the adhering layer at the bag shaped member, and resulting segments of the tear off indications at least partly are removed together with bag material when adapting at least one of a shape, size and position of the inlet opening.

3. Dust bag for vacuum cleaners according to claim 1, wherein a total free length of the bag shaped member is arranged to exceed a length of a bag location to obtain support for a closed end portion of the bag shaped member.

4. Dust bag for vacuum cleaners according to claim 3, wherein a relationship between the total free length (Lu) of the bag shaped member and the length of the bag location (Lb) is not less than $Lu=1.2\times Lb$.

5. Dust bag for vacuum cleaners according to claim 1, wherein adjustment of at least one of a configuration and a size of the inlet opening is done by tearing off operation together with underlying supporting material of the bag shaped member.

6. Dust bag for vacuum cleaners according to claim 1, wherein at least one of a configuration and a size of the inlet opening is adjustable.

7. Dust bag for vacuum cleaners according to claim 1, wherein the bag shaped member includes a restricting member, extending at least partly in a longitudinal direction of the bag shaped member.

8. Dust bag for vacuum cleaners according to claim 1, wherein the adhering layer comprises a number of concentrically arranged ring shaped members.

* * * * *